US010650767B2

(12) United States Patent
Zhao

(10) Patent No.: US 10,650,767 B2
(45) Date of Patent: May 12, 2020

(54) SCAN-DRIVING CIRCUIT AND A DISPLAY DEVICE

(71) Applicant: Wuhan China Star Optoelectronics Technology Co., Ltd., Wuhan, Hubei (CN)

(72) Inventor: Mang Zhao, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 229 days.

(21) Appl. No.: 15/735,924

(22) PCT Filed: Oct. 21, 2017

(86) PCT No.: PCT/CN2017/107175

§ 371 (c)(1),
(2) Date: Dec. 12, 2017

(87) PCT Pub. No.: WO2019/061604

PCT Pub. Date: Apr. 4, 2019

(65) Prior Publication Data

US 2019/0385554 A1 Dec. 19, 2019

(30) Foreign Application Priority Data

Sep. 27, 2017 (CN) ..... 2017 1 0896670

(51) Int. Cl.
*G09G 3/36* (2006.01)

(52) U.S. Cl.
CPC ... *G09G 3/3677* (2013.01); *G09G 2310/0264* (2013.01); *G09G 2330/021* (2013.01)

(58) Field of Classification Search
CPC ..... G09G 3/3677; G09G 2310/0278; G09G 2310/0286; G09G 2310/0264; G11C 19/00; G11C 19/28
See application file for complete search history.

(56) References Cited

U.S. PATENT DOCUMENTS

| | | | | |
|---|---|---|---|---|
| 9,208,737 | B2 | 12/2015 | Hong et al. | |
| 9,672,784 | B2 * | 6/2017 | Cao | G09G 3/3677 |
| 9,824,658 | B2 * | 11/2017 | Cao | G09G 3/3266 |
| 9,905,313 | B2 * | 2/2018 | Hao | G11C 19/28 |
| 10,115,347 | B2 | 10/2018 | Zhao | |
| 10,115,364 | B2 | 10/2018 | Wang | |
| 2015/0228354 | A1 * | 8/2015 | Qing | G11C 19/28 345/100 |

(Continued)

*Primary Examiner* — Sardis F Azongha
(74) *Attorney, Agent, or Firm* — Hemisphere Law, PLLC; Zhigang Ma

(57) ABSTRACT

The present disclosure provides a scan-driving circuit and a display device. The scan-driving circuit includes a plurality of series-connecting scan-driving units including an input circuit generating a pull-up control signal and a pull-down control signal; a latch circuit pulling up or pulling down a pull-up control signal point; a processing circuit generating a current scan-driving signal, a cache circuit driving an output of a current scan-driving signal, and a reset circuit clearing the pull-up control signal point. Therefore, it improves driving flexibility and reduces driving power consumption of the display device, and is beneficial to narrow bezel design.

16 Claims, 4 Drawing Sheets

(56) References Cited

U.S. PATENT DOCUMENTS

| | | | | |
|---|---|---|---|---|
| 2016/0225336 | A1 | 8/2016 | Gu et al. | |
| 2016/0351112 | A1* | 12/2016 | Qing | G09G 3/20 |
| 2016/0365050 | A1* | 12/2016 | Qing | G09G 3/3677 |
| 2017/0039973 | A1* | 2/2017 | Huang | G09G 3/36 |
| 2017/0200408 | A1* | 7/2017 | Zhang | G09G 3/20 |
| 2017/0358266 | A1* | 12/2017 | Zhang | G09G 3/3677 |
| 2018/0059829 | A1* | 3/2018 | Chen | G09G 3/36 |

* cited by examiner

SCAN-DRIVING CIRCUIT AND A DISPLAY DEVICE

RELATED APPLICATIONS

The present application is a National Phase of International Application Number PCT/CN2017/107175, filed on Oct. 21, 2017, and claims the priority of China Application No. 201710896670.X, filed on Sep. 27, 2017.

FIELD OF THE DISCLOSURE

The present disclosure relates to display field, and more particularly, to a scan-driving circuit and a display device.

BACKGROUND

Gate Driver On Array (GOA) is a technology to form a scan-driving signal circuit of gate lines on an array substrate by a thin film transistor (TFT) liquid crystal display (LCD) array process for realizing a driving method of line-by-line scan of a display device. With the development of low temperature polysilicon (LTPS) semiconductor TFTs and due to the ultra-high carrier mobility characteristics of the LTPS semiconductors, the corresponding peripheral integrated circuits of the display device have also become the attention focus in the industry. However, the scan-driving circuit of the conventional display device has only one driving method of the forward scan and the backward scan. This limits the flexibility of driving the display device and is harmful to reducing the driving power consumption. Even if the conventional display device has the driving method of the forward scan and the backward scan, the circuit design is complicated and harmful to reducing power consumption and narrow bezel design.

SUMMARY

For solving the technical problem, the present disclosure provides a scan-driving circuit and a display device to perform a driving method of the forward scan and the backward scan. It improves driving flexibility and reduces driving power consumption of the display device, and is beneficial to narrow bezel design.

For solving the technical problem above, the present disclosure provides an embodiment providing a scan-driving circuit including a plurality of series-connecting scan-driving units. The plurality of series-connecting scan-driving units includes a first scan-driving unit, a plurality of middle scan-driving units, and a last scan-driving unit. The first scan-driving unit, each middle scan-driving unit, and the last scan-driving unit include:

An input circuit is configured to receive a forward-scan control voltage or a backward-scan control voltage, selectively receives a previous scan-driving signal or a next scan-driving signal according to the forward-scan control voltage or the backward-scan control voltage, and generates a pull-up control signal according to the forward-scan control voltage and the previous scan-driving signal, or generates a pull-down control signal according to the backward-scan control voltage and the next scan-driving signal.

A latch circuit is connected to the input circuit, and configured to pull up a pull-up control signal point according to the pull-up control signal and pull down the pull-up control signal point according to the pull-down control signal.

A processing circuit is connected to the latch circuit, and configured to receive a clock signal and generate a current scan-driving signal according to the clock signal and a signal of the pull-up control signal point.

A cache circuit is connected to the processing circuit, and configured to drive an output of a current scan-driving signal.

A reset circuit is connected to the latch circuit, and configured to receive a reset signal to clear the pull-up control signal point.

For solving the technical problem above, the present disclosure provides an embodiment providing a display device including a scan-driving circuit. The scan-driving circuit includes a plurality of series-connecting scan-driving units. The plurality of series-connecting scan-driving units includes a first scan-driving unit, a plurality of middle scan-driving units, and a last scan-driving unit. The first scan-driving unit, each middle scan-driving unit, and the last scan-driving unit include:

An input circuit is configured to receive a forward-scan control voltage or a backward-scan control voltage, selectively receives a previous scan-driving signal or a next scan-driving signal according to the forward-scan control voltage or the backward-scan control voltage, and generates a pull-up control signal according to the forward-scan control voltage and the previous scan-driving signal, or generates a pull-down control signal according to the backward-scan control voltage and the next scan-driving signal.

A latch circuit is connected to the input circuit, and configured to pull up a pull-up control signal point according to the pull-up control signal and pull down the pull-up control signal point according to the pull-down control signal, A processing circuit is connected to the latch circuit, and configured to receive a clock signal and generate a current scan-driving signal according to the clock signal and a signal of the pull-up control signal point.

A cache circuit is connected to the processing circuit, and configured to drive an output of a current scan-driving signal.

A reset circuit is connected to the latch circuit, and configured to receive a reset signal to clear the pull-up control signal point.

The present disclosure has beneficial effect below. To distinguish from the conventional art, the present disclosure provides a scan-driving circuit and a display device outputting the pull-up control signal and the pull-down control signal through the input circuit to realize a driving method of the forward scan and the backward scan. The pull-up control signal point is pulled up and charged or pulled down and cleared through the latch circuit. The current scan-driving signal is generated through the processing circuit and the cache circuit. The scan-driving circuit is cleared through the reset circuit to improve driving flexibility and reduce driving power consumption of the display device. It is beneficial to narrow bezel design.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
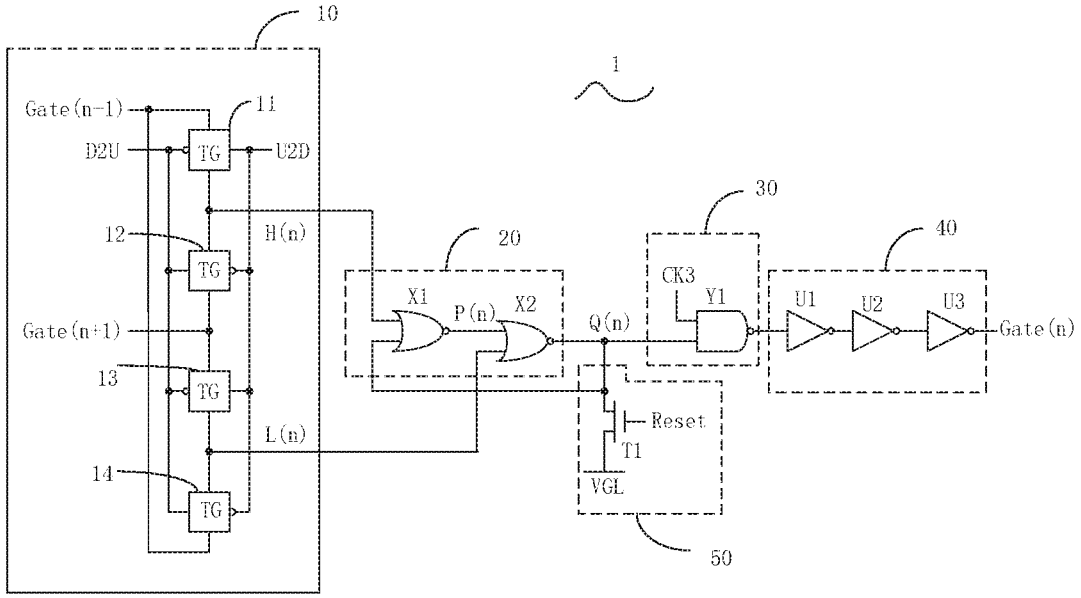
FIG. 1 is a schematic diagram of a scan-driving circuit in accordance with a first embodiment of the present disclosure.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows, Referring to FIG. 1, FIG. 1 is a schematic diagram of a scan-driving circuit in accordance with a first embodiment of the present disclosure. A scan-driving circuit includes a plurality of series-connecting scan-driving units 1. The plurality of series-connecting scan-driving units 1 includes a first scan-driving unit, a plurality of middle scan-driving units, and a last scan-driving unit. The first scan-driving unit, each middle scan-driving unit, and the last scan-driving unit include input circuits 10 to receive a forward-scan control voltage U2D or a backward-scan control voltage D2U. The input circuit 10 selectively receives a previous scan-driving signal Gate(n−1) or a next scan-driving signal Gate(n+1) according to the forward-scan control voltage U2D or the backward-scan control voltage D2U. The pull-up control signal H(n) is generated according to the forward-scan control voltage U2D and the previous scan-driving signal Gate(n−1). Or the pull-down control signal L(n) is generated according to the backward-scan control voltage D2U and the next scan-driving signal Gate(n+1). Thus, the scan-driving circuit realizes a driving method of the forward scan and the backward scan. In the forward scan, the previous scan-driving signal of the first scan-driving unit is a trigger signal STV, and the next scan-driving signal of the last scan-driving unit is the trigger signal STV. In the backward scan, the previous scan-driving signal of the last scan-driving unit is the trigger signal STV, and the next scan-driving signal of the first scan-driving unit is the trigger signal STV.

A latch circuit 20 is connected to the input circuit 10 and configured to pull up a pull-up control signal point Q(n) according to the pull-up control signal H(n) and pull down the pull-up control signal point Q(n) according to the pull-down control signal L(n).

A processing circuit 30 is connected to the latch circuit 20 and configured to receive a clock signal CK and generate a current scan-driving signal Gate(n) according to the clock signal CK and a signal of the pull-up control signal point Q(n).

A cache circuit 40 is connected to the processing circuit 30 and configured to drive an output of the current scan-driving signal Gate(n)

A reset circuit 50 is connected to the latch circuit 20 and configured to receive a reset signal Reset to clear the pull-up control signal point Q(n).

Particularly, the input circuit 10 includes a first transmission gate 11, a second transmission gate 12, a third transmission gate 13, and a fourth transmission gate 14. First control terminals of the first transmission gate 11 and the third transmission gate 13, and second control terminals of the second transmission gate 12 and the fourth transmission gate 14 are connected to the backward-scan control voltage D2U. Second control terminals of the first transmission gate 11 and the third transmission gate 13, and first control terminals of the second transmission gate 12 and the fourth transmission gate 14 are connected to the forward-scan control voltage U2D. Input terminals of the first transmission gate 11 and the fourth transmission gate 14 are connected to the previous scan-driving signal Gate(n−1). An output terminal of the first transmission gate 11 is connected to an output terminal of the second transmission gate 12 and the latch circuit 20. An input terminal of the second transmission gate 12 is connected to an input terminal of the third transmission gate 13 and receives the next scan-driving signal Gate(n+1). An output terminal of the third transmission gate 13 is connected to an output terminal of the fourth transmission gate 14 and the latch circuit 20.

Particularly, the latch circuit 20 includes a first NOR gate X1 and a second NOR gate X2. A first input terminal of the first NOR gate X1 is connected to the output terminal of the first transmission gate 11. A second input terminal of the first NOR gate X1 is connected to an output terminal of the second NOR gate X2 and the processing circuit 30. An output terminal of the first NOR gate X1 is connected to a first input terminal of the second NOR gate X2. A second input terminal of the second NOR gate X2 is connected to an output terminal of the fourth transmission gate 14.

Particularly, the processing circuit 30 includes a NAND gate Y1. A first input terminal of the NAND gate Y1 receives the clock signal CK. A second input terminal of the NAND gate Y1 is connected to the output terminal of the second NOR gate X2. An output terminal of the NAND gate Y1 is connected to the cache circuit 40.

Particularly, the cache circuit 40 includes a first inverter U1, a second inverter U2, and a third inverter U3. An input terminal of the first inverter U1 is connected to an output terminal of the NAND gate Y1. An input terminal of the second inverter U2 is connected to an output terminal of the first inverter U1. An input terminal of the third inverter U3 is connected to an output terminal of the second inverter U2. An output terminal of the third inverter U3 outputs the current scan-driving signal Gate(n).

Particularly, the reset circuit 50 includes a controllable switch T1. A control terminal of the controllable switch T1 receives the reset signal Reset. A first terminal of the controllable switch T1 is connected to the output terminal of the second NOR gate X2. A second terminal of the controllable switch T1 is connected to a turn-off voltage terminal VGL.

In this embodiment, the controllable switch T1 is an N-type thin film transistor (TFT). The control terminal, the first terminal, and the second terminal of the controllable switch T1 respectively correspond to a gate, a source, and a drain of the N-type TFT. In other embodiments, the controllable switch T1 can also be switches of other types as long as the object of the present disclosure can be realized.

Figure 2:
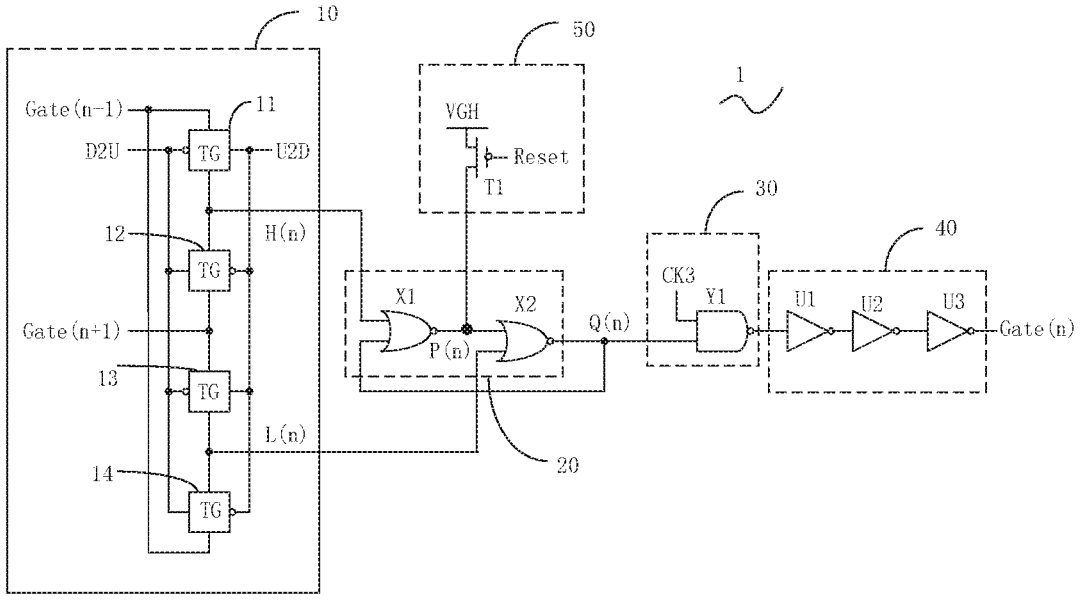
FIG. 2 is a schematic diagram of a scan-driving circuit in accordance with a second embodiment of the present disclosure.

Referring FIG, 2, FIG. 2 is a schematic diagram of a scan-driving circuit in accordance with a second embodiment of the present disclosure. A difference between the second embodiment of the scan-driving circuit and the first embodiment above is that the reset circuit 50 includes the controllable switch T1. The control terminal of the controllable switch T1 receives the reset signal Reset. The first terminal of the controllable switch T1 is connected to a turn-on voltage terminal VGH. The second terminal of the controllable switch T1 is connected to the output terminal of the first NOR gate X1.

In this embodiment, the controllable switch T1 is a P-type TFT. The control terminal, the first terminal, and the second terminal of the controllable switch T1 respectively correspond to a gate, a source, and a drain of the P-type TFT. In other embodiments, the controllable switch T1 can also be switches of other types as long as the object of the present disclosure can be realized.

Figure 3:
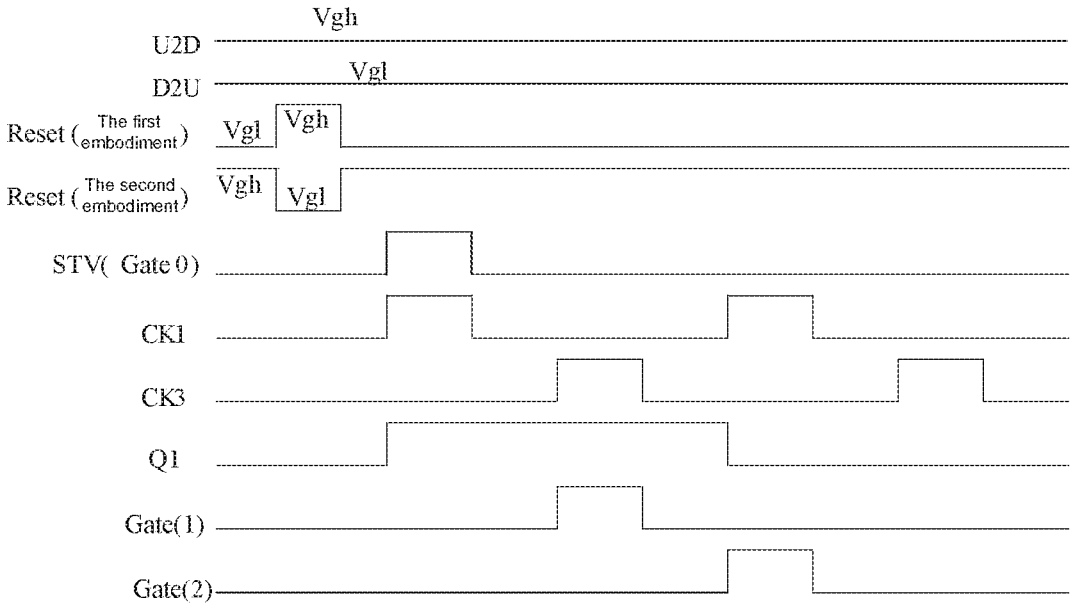
FIG. 3 is a timing diagram of a forward scan of a scan-driving circuit in accordance with an embodiment of the present disclosure.
Figure 5:
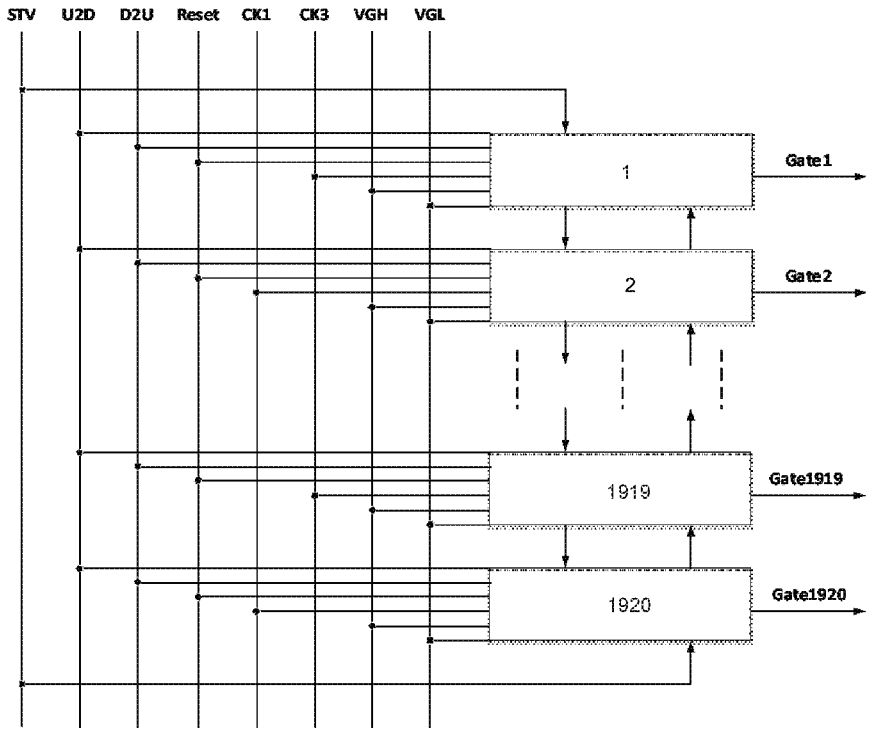
FIG. 5 is a schematic diagram of a driving framework of a scan-driving circuit in accordance with an embodiment of the present disclosure.
Figure 6:
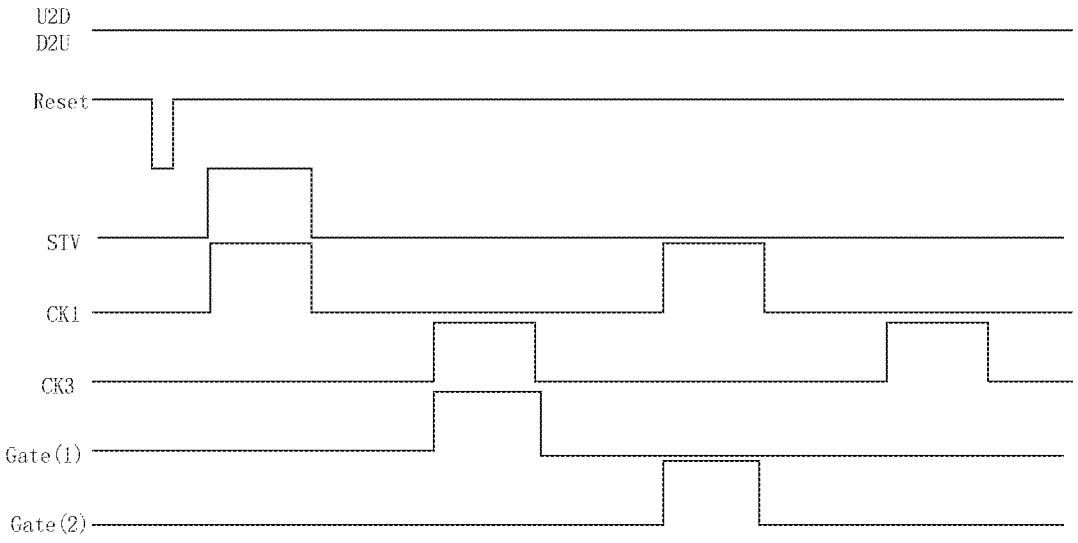
FIG. 6 is a timing diagram of an emulating waveform of a scan-driving circuit in accordance with an embodiment of the present disclosure.

Referring to FIGS. 3, 5 and 6, the working principle of the forward scan of the scan-driving circuit (i.e., scanning from the first scan-driving unit to the last scan-driving unit) is described below. The previous scan-driving signal of the first scan-driving unit is the trigger signal STV. The next scan-driving signal of the first scan-driving unit is Gate(n+1). The previous scan-driving signal of the middle scan-driving unit is Gate(n−1). The next scan-driving signal of the middle scan-driving unit is Gate(n+1). The previous scan-driving signal of the last scan-driving unit is Gate(n−1). The next scan-driving signal of the last scan-driving unit is the trigger signal STV.

In the forward scan, the forward-scan control voltage U2D is at a high level and the backward-scan control voltage D2U is at a low level. The previous scan-driving signal Gate(n−1) is applied to the input circuit 10 to generate the pull-up control signal H(n). The pull-up control signal point Q(n) is pulled up and charged through the pull-up control signal H(n). The next scan-driving signal Gate(n+1) is applied to the input circuit 10 to generate the pull-down control signal L(n). The pull-up control signal point Q(n) is pulled down and cleared through the pull-down control signal L(n). In the first embodiment of the scan-driving circuit, a high-level pulse of the reset signal Reset provides a reset signal to the pull-up control signal point Q(n). In the second embodiment of the scan-driving circuit, the low-level pulse of the reset signal Reset provides the reset signal to the pull-up control signal point Q(n). The pull-up control signal point Q(1) is charged to be at the high level when a high-level pulse of the previous scan-driving signal of the first scan-driving unit (i.e., n=1) arrives. That is, a high-level pulse of the trigger signal STV arrives.

The pull-up control signal point Q(1) always maintains a high-level signal before a high-level pulse signal of the next scan-driving signal Gate(2) is generated. When a high-level pulse signal of the clock signal CK3 arrives, the current scan-driving signal Gate (1) outputs a high-level pulse signal. The current scan-driving signal Gate (1) serves as a previous scan-driving signal of the next scan-driving unit simultaneously. After the high-level pulse signal of the next scan-driving signal Gate(2) is generated, the pull-up control signal point Q(1) is pulled down and cleared to be a low-level signal. The current scan-driving signal Gate (1) stably outputs the low-level signal.

The pull-up control signal point Q(2) is charged to be at the high level when a high-level pulse of the previous scan-driving signal Gate(1) of the middle scan-driving unit arrives. For instance, the middle scan-driving unit can be the second scan-driving unit (i.e., n=2). The pull-up control signal point Q(2) always maintains a high-level signal before a high-level pulse signal of the next scan-driving signal Gate(3) is generated. When a high-level pulse signal of the clock signal CK1 arrives, the current scan-driving signal Gate (2) outputs a high-level pulse signal. The current scan-driving signal Gate (2) serves as a previous scan-driving signal of the next scan-driving unit simultaneously. After the high-level pulse signal of the next scan-driving signal Gate(3) is generated, the pull-up control signal point Q(2) is pulled down and cleared to be a low-level signal. The current scan-driving signal Gate (2) stably outputs the low-level signal.

Figure 4:
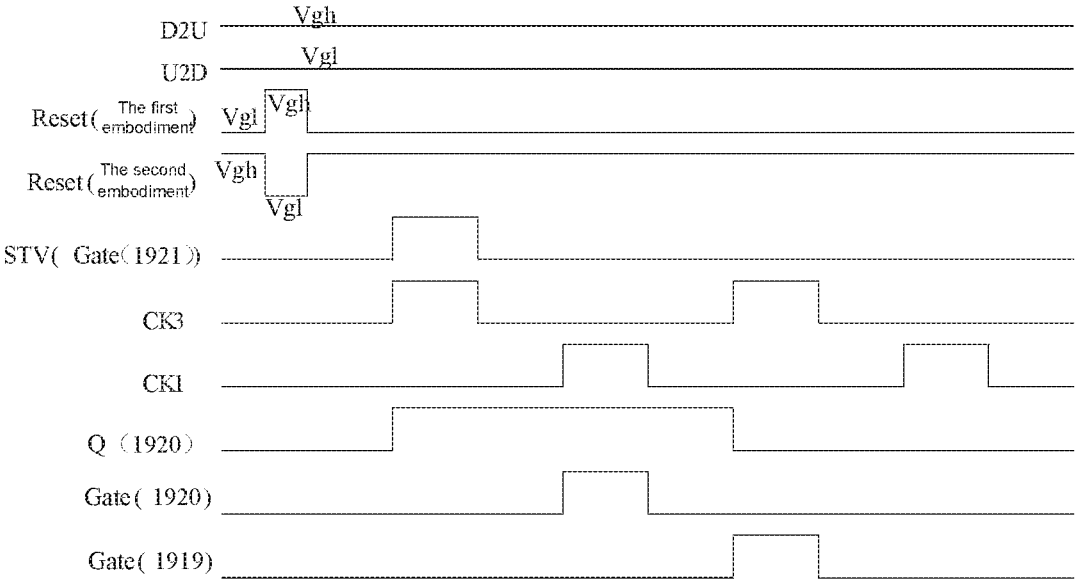
FIG. 4 is a timing diagram of a backward scan of a scan-driving circuit in accordance with an embodiment of the present disclosure.

The pull-up control signal point Q(1920) is charged to be at the high level when a high-level pulse of the previous scan-driving signal Gate(1919) of the last scan-driving unit (i.e., n=1920) arrives. The pull-up control signal point Q(1920) always maintains a high-level signal before a high-level pulse signal of the next scan-driving signal is generated. That is, a high-level pulse of the trigger signal STV is generated. When the high-level pulse signal of the clock signal CK1 arrives, the current scan-driving signal Gate (1920) outputs a high-level pulse signal. After the high-level pulse signal of the next scan-driving signal is generated, the pull-up control signal point Q(1920) is pulled down and cleared to be a low-level signal. That is, the high-level pulse of the trigger signal STV is generated. The current scan-driving signal Gate (1920) stably outputs the low-level signal, Referring to FIGS. 4, 5 and 6, the working principle of the backward scan of the scan-driving circuit (i.e., scanning from the last scan-driving unit to the first scan-driving unit) is described below: The previous scan-driving signal of the last scan-driving unit is the trigger signal STV. The next scan-driving signal of the last scan-driving unit is Gate(n−1). The previous scan-driving signal of the middle scan-driving unit is Gate(n+1). The next scan-driving signal of the middle scan-driving unit is Gate(n−1). The previous scan-driving signal of the first scan-driving unit is Gate(n+1). The next scan-driving signal of the first scan-driving unit is the trigger signal STV.

In the backward scan, the forward-scan control voltage U2D is at a low level and the backward-scan control voltage D2U is at a high level. The previous scan-driving signal Gate(n+1) is applied to the input circuit 10 to generate the pull-up control signal H(n). The pull-up control signal point Q(n) is pulled up and charged through the pull-up control signal H(n). The next scan-driving signal Gate(n−1) is applied to the input circuit 10 to generate the pull-down control signal L(n). The pull-up control signal point Q(n) is pulled down and cleared through the pull-down control signal L(n). In the first embodiment of the scan-driving circuit, the high-level pulse of the reset signal Reset provides the reset signal to the pull-up control signal point Q(n). In the second embodiment of the scan-driving circuit, the low-level pulse of the reset signal Reset provides the reset signal to the pull-up control signal point Q(n). The pull-up control signal point Q(1920) is charged to be at the high level when a high-level pulse of the previous scan-driving signal of the last scan-driving unit (i.e., n =1920) arrives. That is, a high-level pulse of the trigger signal STV arrives. The pull-up control signal point Q(1920) always maintains a high-level signal before a high-level pulse signal of the next scan-driving signal Gate(1919) is generated. When a high-level pulse signal of the clock signal CK3 arrives, the current scan-driving signal Gate (1920) outputs a high-level pulse signal. The current scan-driving signal Gate (1920) serves as a previous scan-driving signal of the penultimate scan-driving unit (i.e., n=1919) simultaneously. After the high-level pulse signal of the penultimate scan-driving signal Gate(1919) is generated, the pull-up control signal point Q(1920) is pulled down and cleared to be a low-level signal. The current scan-driving signal Gate (1920) stably outputs the low-level signal.

The pull-up control signal point Q(1919) is charged to be at the high level when a high-level pulse of the previous scan-driving signal Gate(1920) of the middle scan-driving unit arrives. For instance, the middle scan-driving unit can be the penultimate scan-driving unit (i.e., n=1919). The pull-up control signal point Q(1919) always maintains a high-level signal before a high-level pulse signal of the next scan-driving signal Gate(1918) is generated. When a high-level pulse signal of the clock signal CK3 arrives, the current scan-driving signal Gate(1919) outputs the high-level pulse signal. The current scan-driving signal Gate(1919) serves as a previous scan-driving signal of the third from last scan-driving unit (i.e., n=1918) simultaneously. After the high-level pulse signal of the third from last scan-driving signal Gate(1918) is generated, the pull-up control signal point Q(1919) is pulled down and cleared to be a low-level signal. The current scan-driving signal Gate(1919) stably outputs the low-level signal.

The pull-up control signal point Q(1) is charged to be at the high level when a high-level pulse of the previous scan-driving signal Gate(2) of the first scan-driving unit (i.e., n=1) arrives. The pull-up control signal point Q(1) always maintains a high-level signal before a high-level pulse signal of the next scan-driving signal is generated. That is, the high-level pulse of the trigger signal STV is generated. When a high-level pulse signal of the clock signal CK3 arrives, the current scan-driving signal Gate(1) outputs a high-level pulse signal. After the high-level pulse signal of the next scan-driving signal is generated, the pull-up control signal point Q(1) is pulled down and cleared to be a low-level signal. That is, the high-level pulse of the trigger signal STV is generated. The current scan-driving signal Gate(1) stably outputs the low-level signal.

Referring to FIGS. 5 and 6, the unilateral scan-driving circuit needs a trace of the trigger signal STV for the input of the first scan-driving unit or the last scan-driving unit. The unilateral scan-driving circuit needs a trace of the forward-scan control voltage U2D and a trace of backward-scan control voltage D2U for the control of the forward scan and the backward scan of the scan-driving circuit. The unilateral scan-driving circuit needs two traces of the clock signal CK for generating the scan-driving signal. One of the clock signal traces CK3 is to provide the clock signals for odd-numbered scan-driving units and the other clock signal trace CM is to provide the clock signals for even-numbered scan-driving units. The unilateral scan-driving circuit needs a trace of the reset signal Reset for the reset processing of each scan-driving unit. The unilateral scan-driving circuit needs a trace of the turn-on voltage terminal VGH and a trace of the turn-off voltage terminal VGL for power driving of the scan-driving circuit. The scan-driving circuit works well through the signal waveform shown in FIG, 6.

Figure 7:
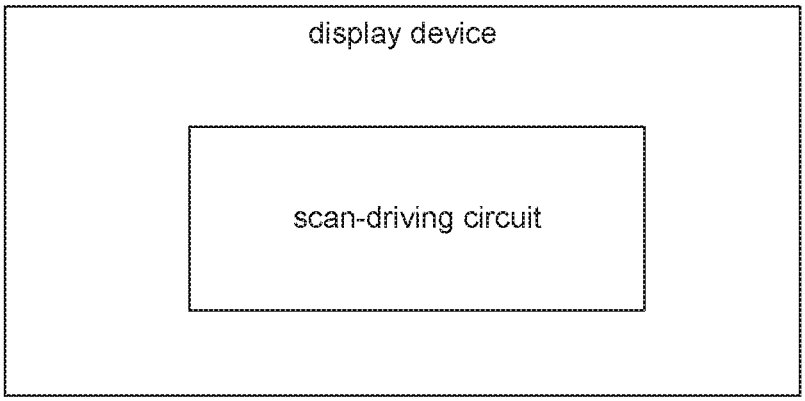
FIG. 7 is a schematic diagram of a display device in accordance with an embodiment of the present disclosure.

Referring to FIG. 7, FIG. 7 is a schematic diagram of a display device in accordance with an embodiment of the present disclosure. The display device includes the scan-driving circuit described above. The other components and functions of the display device are the same as those of the conventional display device. It is not iterated.

The scan-driving circuit and the display device output the pull-up control signal and the pull-down control signal through the input circuit to realize the control of the forward scan and the backward scan. The pull-up control signal point is pulled up and charged or pulled down and cleared through the latch circuit. The current scan-driving signal is generated through the processing circuit and the cache circuit. The scan-driving circuit is cleared through the reset circuit to improve driving flexibility and reduce driving power consumption of the display device.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application,

What is claimed is:

1. A scan-driving circuit comprising a plurality of series-connecting scan-driving units comprising a first scan-driving unit, a plurality of middle scan-driving units, and a last scan-driving unit, the first scan-driving unit, each middle scan-driving unit, and the last scan-driving unit comprising:

an input circuit, configured to receive a forward-scan control voltage or a backward-scan control voltage, selectively receiving a previous scan-driving signal or a next scan-driving signal according to the forward-scan control voltage or the backward-scan control voltage, and generating a pull-up control signal according to the forward-scan control voltage and the previous scan-driving signal, or generating a pull-down control signal according to the backward-scan control voltage and the next scan-driving signal;

a latch circuit, connected to the input circuit, configured to pull up a pull-up control signal point according to the pull-up control signal and pull down the pull-up control signal point according to the pull-down control signal;

a processing circuit, connected to the latch circuit, configured to receive a clock signal and generate a current scan-driving signal according to the clock signal and a signal of the pull-up control signal point;

a cache circuit, connected to the processing circuit, configured to drive an output of a current scan-driving signal; and a reset circuit, connected to the latch circuit, configured to receive a reset signal to clear the pull-up control signal point;

wherein the input circuit comprises a first transmission gate, a second transmission gate, a third transmission gate, and a fourth transmission gate, first control terminals of the first transmission gate and the third transmission gate and second control terminals of the second transmission gate and the fourth transmission gate are connected to the backward-scan control voltage, second control terminals of the first transmission gate and the third transmission gate and the first control terminals of the second transmission gate and the fourth transmission gate are connected to the forward-scan control voltage, input terminals of the first transmission gate and the fourth transmission gate are connected to the previous scan-driving signal, an output terminal of the first transmission gate is connected to an output terminal of the second transmission gate and the latch circuit, the input terminal of the second transmission gate is connected to an input terminal of the third transmission gate and receives the next scan-driving signal, and an output terminal of the third transmission gate is connected to an output terminal of the fourth transmission gate and the latch circuit.

2. The scan-driving circuit of claim 1, wherein the latch circuit comprises a first NOR gate and a second NOR gate, a first input terminal of the first NOR gate is connected to the output terminal of the first transmission gate, a second input terminal of the first NOR gate is connected to an output terminal of the second NOR gate and the processing circuit, an output terminal of the first NOR gate is connected to a first input terminal of the second NOR gate, and a second input terminal of the second NOR gate is connected to an output terminal of the fourth transmission gate.

3. The scan-driving circuit of claim 2, wherein the processing circuit comprises a NAND gate, a first input terminal of the NAND gate receives the clock signal, a second input terminal of the NAND gate is connected to the output terminal of the second NOR gate, and an output terminal of the NAND gate is connected to the cache circuit.

4. The scan-driving circuit of claim 3, wherein the cache circuit comprises a first inverter, a second inverter, and a third inverter, an input terminal of the first inverter is connected to an output terminal of the NAND gate, an input terminal of the second inverter is connected to an output of the first inverter, an input terminal of the third inverter is connected to an output terminal of the second inverter, and an output terminal of the third inverter outputs the current scan-driving signal.

5. The scan-driving circuit of claim 2, wherein the reset circuit comprises a controllable switch, a control terminal of the controllable switch receives the reset signal, a first terminal of the controllable switch is connected to the output terminal of the second NOR gate, and a second terminal of the controllable switch is connected to a turn-off voltage terminal.

6. The scan-driving circuit of claim 5, wherein the controllable switch is an N-type thin film transistor (TFT), the control terminal, the first terminal, and the second terminal of the controllable switch respectively correspond to a gate, a source, and a drain of the N-type TFT.

7. The scan-driving circuit of claim 2, wherein the reset circuit comprises a controllable switch, a control terminal of the controllable switch receives the reset signal, a first terminal of the controllable switch is connected to a turn-on voltage terminal, and a second terminal of the controllable switch is connected to the output terminal of the first NOR gate.

8. The scan-driving circuit of claim 7, wherein the controllable switch is a P-type TFT, the control terminal, the first terminal, and the second terminal of the controllable switch respectively correspond to a gate, a source, and a drain of the P-type TFT.

9. A display device comprising a scan-driving circuit comprising a plurality of series-connecting scan-driving units comprising a first scan-driving unit, a plurality of middle scan-driving units, and a last scan-driving unit, the first scan-driving unit, each middle scan-driving unit, and the last scan-driving unit comprising:

an input circuit, configured to receive a forward-scan control voltage or a backward-scan control voltage, selectively receiving a previous scan-driving signal or a next scan-driving signal according to the forward-scan control voltage or the backward-scan control voltage, and generating a pull-up control signal according to the forward-scan control voltage and the previous scan-driving signal, or generating a pull-down control signal according to the backward-scan control voltage and the next scan-driving signal;

a latch circuit, connected to the input circuit, configured to pull up a pull-up control signal point according to the pull-up control signal and pull down the pull-up control signal point according to the pull-down control signal;

a processing circuit, connected to the latch circuit, configured to receive a clock signal and generate a current scan-driving signal according to the clock signal and a signal of the pull-up control signal point;

a cache circuit, connected to the processing circuit, configured to drive an output of a current scan-driving signal; and a reset circuit, connected to the latch circuit, configured to receive a reset signal to clear the pull-up control signal point;

wherein the input circuit comprises a first transmission gate, a second transmission gate, a third transmission gate, and a fourth transmission gate, first control terminals of the first transmission gate and the third transmission gate and second control terminals of the second transmission gate and the fourth transmission gate are connected to the backward-scan control voltage, second control terminals of the first transmission gate and the third transmission gate and the first control terminals of the second transmission gate and the fourth transmission gate are connected to the forward-scan control voltage, input terminals of the first transmission gate and the fourth transmission gate are connected to the previous scan-driving signal, an output terminal of the first transmission gate is connected to an output terminal of the second transmission gate and the latch circuit, the input terminal of the second transmission gate is connected to an input terminal of the third transmission gate and receives the next scan-driving signal, and an output terminal of the third transmission gate is connected to an output terminal of the fourth transmission gate and the latch circuit.

10. The display device of claim 9, wherein the latch circuit comprises a first NOR gate and a second NOR gate, a first input terminal of the first NOR gate is connected to the output terminal of the first transmission gate, a second input terminal of the first NOR gate is connected to an output terminal of the second NOR gate and the processing circuit, an output terminal of the first NOR gate is connected to a first input terminal of the second NOR gate, and a second input terminal of the second NOR gate is connected to an output terminal of the fourth transmission gate.

11. The display device of claim 10, wherein the processing circuit comprises a NAND gate, a first input terminal of the NAND gate receives the clock signal, a second input terminal of the NAND gate is connected to the output terminal of the second NOR gate, and an output terminal of the NAND gate is connected to the cache circuit.

12. The display device of claim 11, wherein the cache circuit comprises a first inverter, a second inverter, and a third inverter, an input terminal of the first inverter is connected to an output terminal of the NAND gate, an input terminal of the second inverter is connected to an output of the first inverter, an input terminal of the third inverter is connected to an output terminal of the second inverter, and an output terminal of the third inverter outputs the current scan-driving signal.

13. The display device of claim 10, wherein the reset circuit comprises a controllable switch, a control terminal of the controllable switch receives the reset signal, a first terminal of the controllable switch is connected to the output terminal of the second NOR gate, and a second terminal of the controllable switch is connected to a turn-off voltage terminal.

14. The display device of claim 13, wherein the controllable switch is an N-type thin film transistor (TFT), the control terminal, the first terminal, and the second terminal of the controllable switch respectively correspond to a gate, a source, and a drain of the N-type TFT.

15. The display device of claim 10, wherein the reset circuit comprises a controllable switch, a control terminal of the controllable switch receives the reset signal, a first terminal of the controllable switch is connected to a turn-on voltage terminal, and a second terminal of the controllable switch is connected to the output terminal of the first NOR gate.

16. The display device of claim 15, wherein the controllable switch is a P-type TFT, the control terminal, the first terminal, and the second terminal of the controllable switch respectively correspond to a gate, a source, and a drain of the P-type TFT.

* * * * *